US011014324B2

(12) United States Patent
Béguin et al.

(10) Patent No.: US 11,014,324 B2
(45) Date of Patent: May 25, 2021

(54) SLEEVE EXTRACTOR, UNIT FOR CONVERTING A FLAT SUBSTRATE, AND METHOD FOR EXTRACTING SLEEVES

(71) Applicant: BOBST MEX SA, Mex (CH)

(72) Inventors: Boris Béguin, Féchy (CH); Philippe Clément, Penthalaz (CH); Guillaume Dénisse, Féternes (FR)

(73) Assignee: BOBST MEX SA

( * ) Notice: Subject to any disclaimer, the term of this patent is extended or adjusted under 35 U.S.C. 154(b) by 0 days.

(21) Appl. No.: 15/531,808

(22) PCT Filed: Nov. 26, 2015

(86) PCT No.: PCT/EP2015/025091

§ 371 (c)(1),
(2) Date: May 31, 2017

(87) PCT Pub. No.: WO2016/087051

PCT Pub. Date: Jun. 9, 2016

(65) Prior Publication Data

US 2017/0326831 A1 Nov. 16, 2017

(30) Foreign Application Priority Data

Dec. 4, 2014 (EP) ..... 14020103

(51) Int. Cl.
*B31B 50/14* (2017.01)
*B31F 1/07* (2006.01)
(Continued)

(52) U.S. Cl.
CPC ..... *B31F 1/07* (2013.01); *B31B 50/146* (2017.08); *B31B 50/256* (2017.08); *B31B 50/88* (2017.08);
(Continued)

(58) Field of Classification Search
CPC ..... B31B 50/88; B31B 51/146; B31B 50/256; B31B 2110/35; B31F 2201/0723;
(Continued)

(56) References Cited

U.S. PATENT DOCUMENTS 1,468,344 A * 9/1923 Hartman ..... E21B 19/12 254/29 R
1,574,349 A * 2/1926 Johanson ..... A47J 45/10 294/28
(Continued)

FOREIGN PATENT DOCUMENTS

DE 10 2009 023 170 A1 12/2010
DE 10 2010 027 181 A1 1/2012
(Continued)

OTHER PUBLICATIONS

International Search Report dated Feb. 26, 2016 in corresponding PCT International Application No. PCT/EP2015/025091.
(Continued)

*Primary Examiner* — Matthew G Marini
*Assistant Examiner* — Marissa Ferguson-Samreth
(74) *Attorney, Agent, or Firm* — Ostrolenk Faber LLP

(57) ABSTRACT

A rotary-tool sleeve extractor for a unit for converting a flat substrate that includes a base (23) intended to be fixed to the conversion unit (7) and an extraction head (24) that: a) is movable with respect to the base (23) between a withdrawn position and a deployed position and, b) has a gripper (25) that can engage with a sleeve (13) of a rotary tool (10, 11).

9 Claims, 5 Drawing Sheets

(51) Int. Cl.
*B31B 50/25* (2017.01)
*B31B 50/88* (2017.01)
*B31B 110/35* (2017.01)

(52) U.S. Cl.
CPC ... *B31B 2110/35* (2017.08); *B31F 2201/0723* (2013.01); *B31F 2201/0776* (2013.01)

(58) Field of Classification Search
CPC ..... B31F 2201/0776; B41F 27/14; B41F 27/105; B41F 27/00; B41F 27/04; B41F 27/06; B41F 27/08; B41F 27/10; B41F 27/1206; B41F 30/00; B41F 30/02; B41F 30/04; B41F 30/06; B41P 2200/12; B41P 2217/21; B41P 2227/20; B41P 2227/21; B41P 2227/62; B41P 2227/63
See application file for complete search history.

(56) References Cited

U.S. PATENT DOCUMENTS 4,005,893 A * 2/1977 Tash ..... A47J 43/283 294/118
4,570,431 A * 2/1986 Igel ..... D01H 9/001 198/803.3
4,697,838 A * 10/1987 Hartman ..... B25J 9/1015 294/115
4,728,137 A * 3/1988 Hamed ..... B25J 15/0266 269/228
5,476,298 A * 12/1995 Etemadian ..... A01B 1/18 294/115
6,250,223 B1 * 6/2001 Dufour ..... B41F 27/105 101/217
6,386,103 B1 * 5/2002 Charette ..... B41F 27/105 101/375
7,156,004 B1 * 1/2007 Whitehead ..... B25B 7/02 81/420
7,225,736 B2 * 6/2007 Blom ..... B41F 27/105 101/375
7,255,043 B2 * 8/2007 Fischer ..... B41F 27/105 101/375
7,331,288 B2 * 2/2008 Gottling ..... B41C 1/05 101/216
8,210,587 B2 * 7/2012 Mizelmoe ..... B66C 1/427 294/106
2004/0139873 A1 * 7/2004 Gottling ..... B41F 27/105 101/375
2004/0217612 A1 * 11/2004 Slettedal ..... E21B 19/14 294/202
2005/0166774 A1 * 8/2005 Blom ..... B41F 27/105 101/216
2010/0289286 A1 * 11/2010 Unmuth ..... B25J 15/106 294/106
2011/0148133 A1 * 6/2011 Hessels ..... E21B 19/163 294/197
2016/0121490 A1 * 5/2016 Ottersland ..... E21B 19/14 294/198

FOREIGN PATENT DOCUMENTS

WO WO 2006/061869 A1 6/2006
WO WO 2012/065689 A1 5/2012

OTHER PUBLICATIONS

Written Opinion dated Feb. 26, 2016 in corresponding PCT International Application No. PCT/EP2015/025091.

* cited by examiner

SLEEVE EXTRACTOR, UNIT FOR CONVERTING A FLAT SUBSTRATE, AND METHOD FOR EXTRACTING SLEEVES

CROSS-REFERENCE TO RELATED APPLICATION

The present application is a 35 U.S.C. §§ 371 national phase conversion of PCT/EP2015/025091, filed Nov. 26, 2015, which claims priority of European Patent Application No. 14020103.9, filed Dec. 4, 2014, the contents of all of which are incorporated herein by reference. The PCT International Application was published in the French language.

FIELD OF THE INVENTION

The present invention relates to a rotary-tool sleeve extractor for a unit for converting a flat substrate. The invention relates to a unit for converting a flat substrate, comprising at least one sleeve extractor. The invention also relates to a method for extracting sleeves.

BACKGROUND

A machine for converting a substrate is intended for the production of packaging. In this machine, an initial flat substrate, such as a continuous web of cardboard, is unrolled and printed on by a printing station comprising one or more printer units. The flat substrate is then transferred into an introduction unit and then into an embossing unit, possibly followed by a scoring unit. The flat substrate is then cut in a cutting unit. After ejection of the scrap areas, the preforms obtained are sectioned in order to obtain individual boxes.

The rotary conversion unit may be an embossing unit, a scoring unit, a cutting unit, a scrap-ejection unit, or a printer unit. Each conversion unit comprises a cylindrical upper conversion tool and a cylindrical lower conversion tool, between which the flat substrate passes in order to be converted. In operation, the rotary conversion tools rotate at the same speed but in opposite directions to one another. The flat substrate passes through the gap situated between the rotary tools, which form a relief by embossing, form a relief by scoring, cut the flat substrate into preforms by rotary cutting, eject the scrap, or print a pattern during printing.

The cylinder changing operations have been found to be time-consuming and tedious. The operator must mechanically disconnect the cylinder in order to remove the cylinder from its drive mechanism. Then, the operator must extract the cylinder from the conversion machine and fit the new cylinder in the conversion machine by reconnecting the cylinder to its drive. The weight of a cylinder is high, around 50 kg to 2000 kg. In order to extract the cylinder, the operator must lift the cylinder with the aid of a hoist.

Because of its fairly high weight, a cylinder cannot be changed very quickly. Moreover, numerous tool changes may be necessary to obtain a very large number of boxes that are different from one another. These tools have to be ordered a long time in advance, which is becoming incompatible with the production changes that are currently required. In addition, tools are relatively expensive to produce and they only become cost-effective with an extremely large output.

Therefore, some conversion units have rotary tools made up of a mandrel and a removable sleeve carrying the form for carrying out the conversion that is able to be fitted on the mandrel. All that is necessary is to change the sleeve rather than the entire rotary tool. This makes it easier to change the tool because the low weight of the sleeve and reduces costs since the sleeve is less expensive.

The passage of the flat substrate through the successive conversion units tends to heat the flat substrate, notably as the substrate passes through the printer units. The heated flat substrate in turn heats the rotary tools since the latter, which are generally metallic, are very good conductors of heat. The dimensions of a sleeve are thus generally provided in order to limit the play between the sleeve and the mandrel during conversion operations. A resulting difficulty is that when the conversion unit is stopped, the sleeve, which has better thermal conductivity than the mandrel, cools down more quickly than the latter. It is then difficult to remove the sleeve from the mandrel.

SUMMARY OF THE INVENTION

An aim of the present invention is to propose a device and a method which at least partially solve the drawbacks of the prior art.

To this end, an object of the present invention is a rotary-tool sleeve extractor for a unit for converting a flat substrate, the sleeve extractor comprising a base intended to be fixed to the conversion unit and an extraction head. The extraction head is movable with respect to the base between a withdrawn position and a deployed position. The extraction head comprises a gripper that can engage with a sleeve of a rotary tool.

The conversion unit is defined as being a scoring unit, an embossing unit, a rotary cutting unit, a scrap ejection unit, a printer unit, chosen on its own or in combination, or the like. In order to extract the sleeve, the sleeve extractor engages with the sleeve and slides it along the mandrel in order to withdraw the sleeve. The extractor makes it possible to remove the sleeve easily from the mandrel and is suitable for the extraction of different sleeves having small or large diameters.

According to one exemplary embodiment, the gripper comprises a gripper actuator. The gripper actuator is arranged, for example, between two pivoting arms of the gripper. The gripper actuator makes it possible for the opening and closing of the gripper to be controlled in an automatic manner by the conversion unit.

According to one exemplary embodiment, the sleeve extractor comprises a head actuator for moving the extraction head between the withdrawn position and the deployed position. The head actuator makes it possible for the conversion unit to automatically control movement of the extraction head.

The extraction head comprises, for example, a guide member that engages with a complementary guide member of the base in order to guide the movement of the extraction head between the withdrawn position and the deployed position.

According to one exemplary embodiment, the gripper comprises at least one gripping jaw mounted in a pivotable manner in an arm of the gripper. The gripping jaw comprises, for example, a shoulder in the form of a circular arc that is intended to receive an end portion of sleeve. The gripping jaw bears against the sleeve, making it possible to push the latter along the mandrel. The pivoting gripping jaws are positioned correctly at the sleeve, adapting to the diameter thereof. These jaws comprise a part made of synthetic material in order to avoid the risks of damage to the sleeve, and a metal part, in order to be sufficiently rigid to be able to subsequently push the sleeve over the mandrel.

A further subject of the invention is a unit for converting a flat substrate, such as a scoring unit, an embossing unit, a rotary cutting unit, a scrap ejection unit, a printer unit, comprising at least one sleeve extractor as described and claimed below, the extraction head of which is movable between a withdrawn position and a deployed position, wherein the extraction head is deployed in a direction parallel to the axis of rotation of the mandrels.

According to one exemplary embodiment, the conversion unit comprises two sleeve extractors being mounted one above the other, facing one another, and being on either side of bearings of the conversion unit that are intended to support the ends of the mandrels.

A further subject of the invention is a method for extracting a sleeve from a conversion unit as described and claimed below, comprising the steps of:

bringing the gripper of the extraction head into engagement with the end of the sleeve in order to start the extraction of the sleeve, and then deploying the extraction head in order to push the sleeve along the mandrel until it has been completely extracted from the conversion unit.

BRIEF DESCRIPTION OF THE FIGURES

Further advantages and features will become apparent from reading the description of the invention and from the appended figures, which show a nonlimiting exemplary embodiment of the invention and in which.

Figure 2:
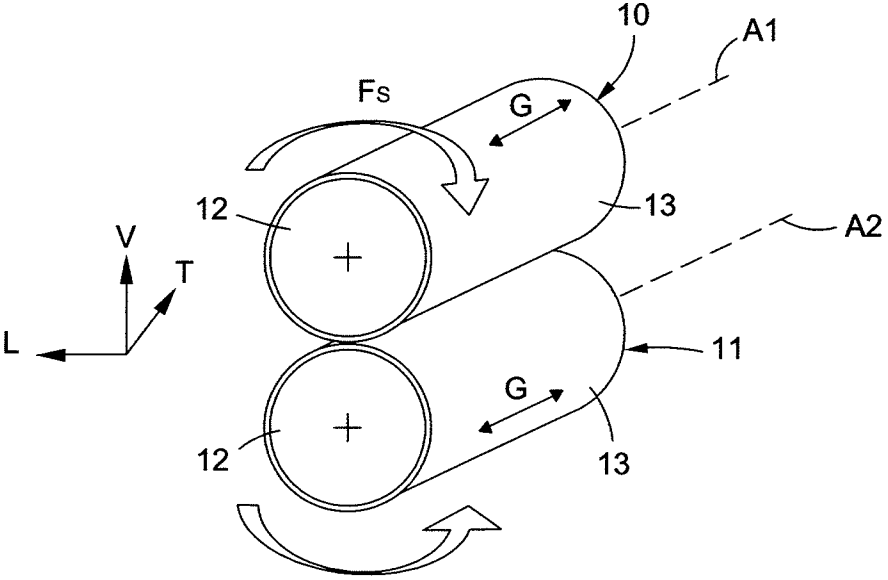
FIG. 2 shows a perspective view of an upper rotary tool and of a lower rotary tool.

The longitudinal, vertical and transverse directions indicated in FIG. 2 are defined by the trihedron L, V, T. The transverse direction T is the direction perpendicular to the longitudinal direction of movement L of the flat substrate. The horizontal plane corresponds to the plane L, T. The front and rear positions are defined with respect to the transverse direction T as being on the side of the driver and on the opposite side from the driver, respectively.

DETAILED DESCRIPTION OF PREFERRED EMBODIMENTS

Figure 1:
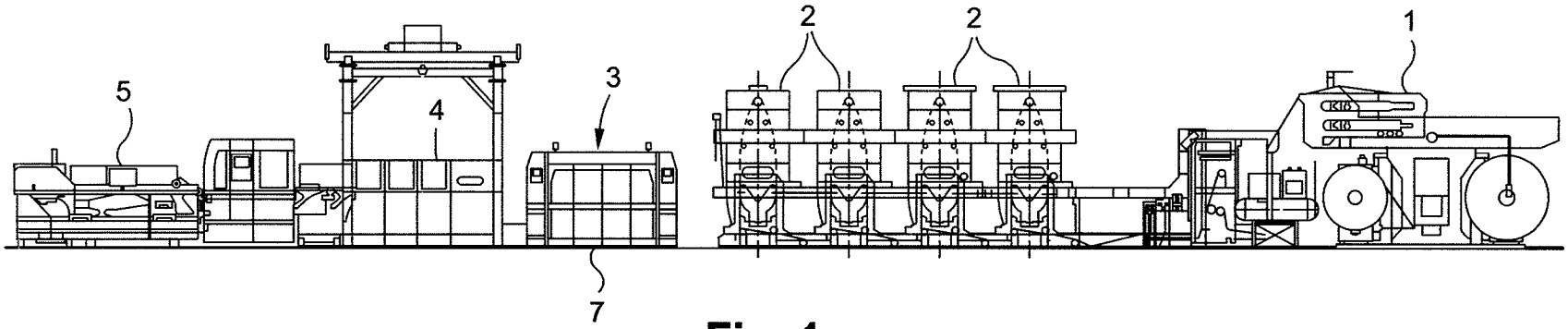
FIG. 1 is an overall view of an example of a conversion line for converting a flat substrate.

A conversion line for converting a flat substrate, such as a flat cardboard or a continuous web of paper wound on a reel, makes it possible to carry out various operations and obtain packaging such as folding boxes. As shown in FIG. 1, the conversion line comprises, disposed one after another in the order of passage of the flat substrate, an unwinding station 1, several printer units 2, one or more embossing units in series followed by one or more scoring units in series 3, followed by a rotary cutting unit 4 or platen die-cutting unit, and a station 5 for receiving the manufactured objects.

The conversion unit 7 comprises an upper rotary tool 10 and a lower rotary tool 11, which modify the flat substrate by printing, embossing, scoring, cutting, ejection of scrap, etc., in order to obtain the packaging.

The rotary tools 10 and 11 are mounted parallel to one another in the conversion unit 7, one above the other, and extend in the transverse direction T, which is also the direction of the axes of rotation A1 and A2 of the rotary tools 10 and 11 (see FIG. 2). The rear ends of the rotary tools 10 and 11, on the opposite side from the driver, are rotated by motorized drive means. In operation, the rotary tools 10 and 11 rotate in opposite directions about each of the axes of rotation A1 and A2 (arrows Fs and Fi). The flat substrate passes through the gap situated between the rotary tools 10 and 11 in order to be embossed and/or scored and/or cut and/or printed on therein.

At least one of the two rotary tools, the upper rotary tool 10 or the lower rotary tool 11, comprises a mandrel 12 and a removable sleeve 13 that is able to be fitted on the mandrel 12 in the transverse direction T (arrow G in FIG. 2). Thus, when changing the rotary tools 10 and 11 is desired, all that is necessary is to change the sleeves 13 rather than the entire rotary tool 10 and 11. Since it is easier to handle the sleeve 13 because of its low weight relative to that of the entire rotary tool 10 and 11, the change of operation can be effected rapidly. Moreover, the sleeves 13 are inexpensive compared with the price of the rotary tool 10 and 11 as a whole. It is thus advantageous to use one and the same mandrel 12 in combination with several sleeves 13 rather than to acquire several entire rotary tools 10 and 11. The sleeve 13 has a hollow and cylindrical overall shape. It is made for example of aluminum material.

Figure 3:
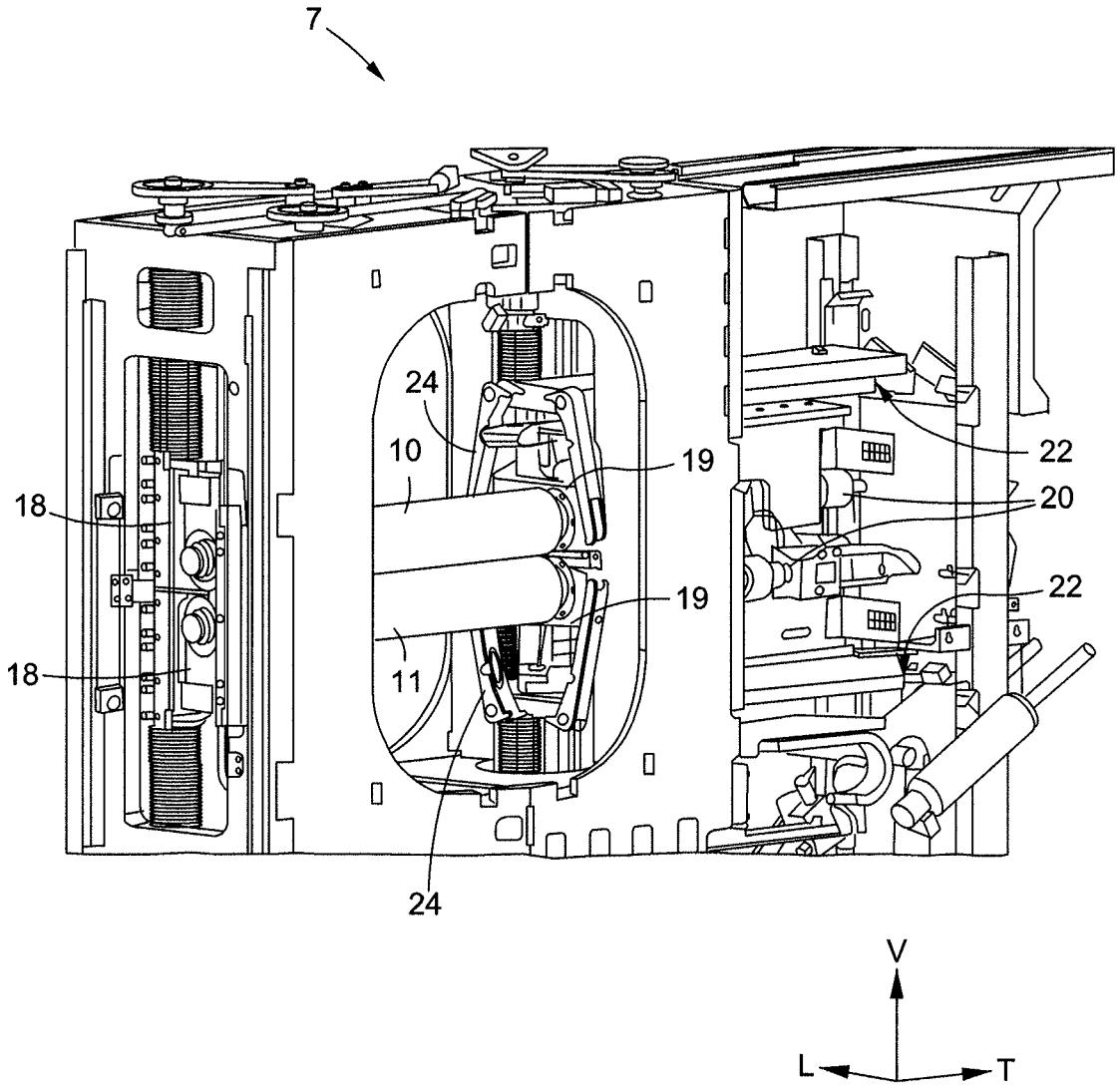
FIG. 3 shows a perspective view of two sleeve extractors mounted in a conversion unit in the withdrawn position.
Figure 4:
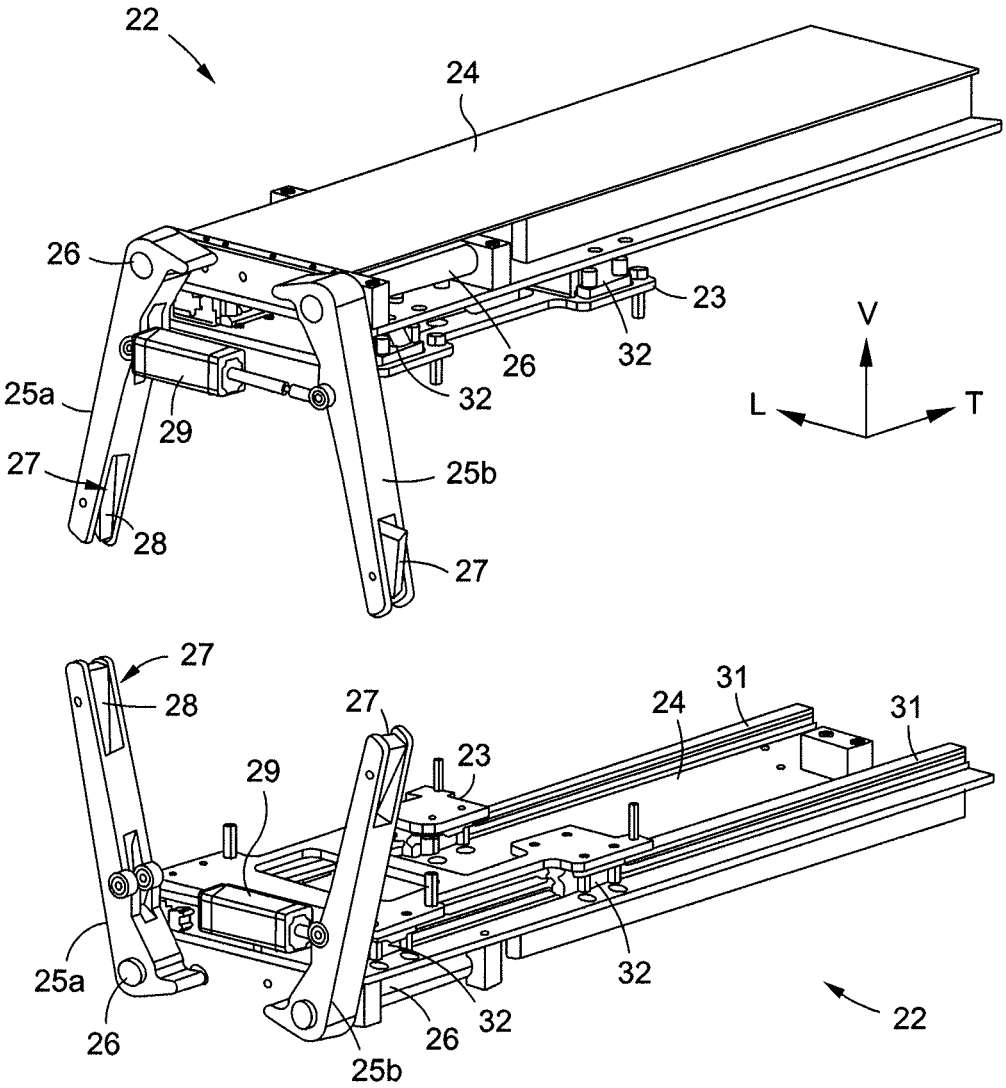
FIG. 4 shows a perspective view of just the sleeve extractors from FIG. 3.

The mandrel 12 comprises a cylindrical core, a front end, and a rear end, which are situated on either side of the cylindrical core. The front and rear ends of the mandrel 12 are supported by front and rear bearings 18 and 19, respectively, of the conversion unit 7 (FIG. 3). In operation, the rear ends of the mandrels 12 of the rotary tools 10 and 11, on the opposite side from the driver, are driven in rotation by a respective motorized drive system 20.

The conversion unit 7 also comprises two sleeve extractors 22. Each sleeve extractor 22 comprises a base 23 and an extraction head 24. The base 23 is fixed to the conversion unit 7.

Figure 7:
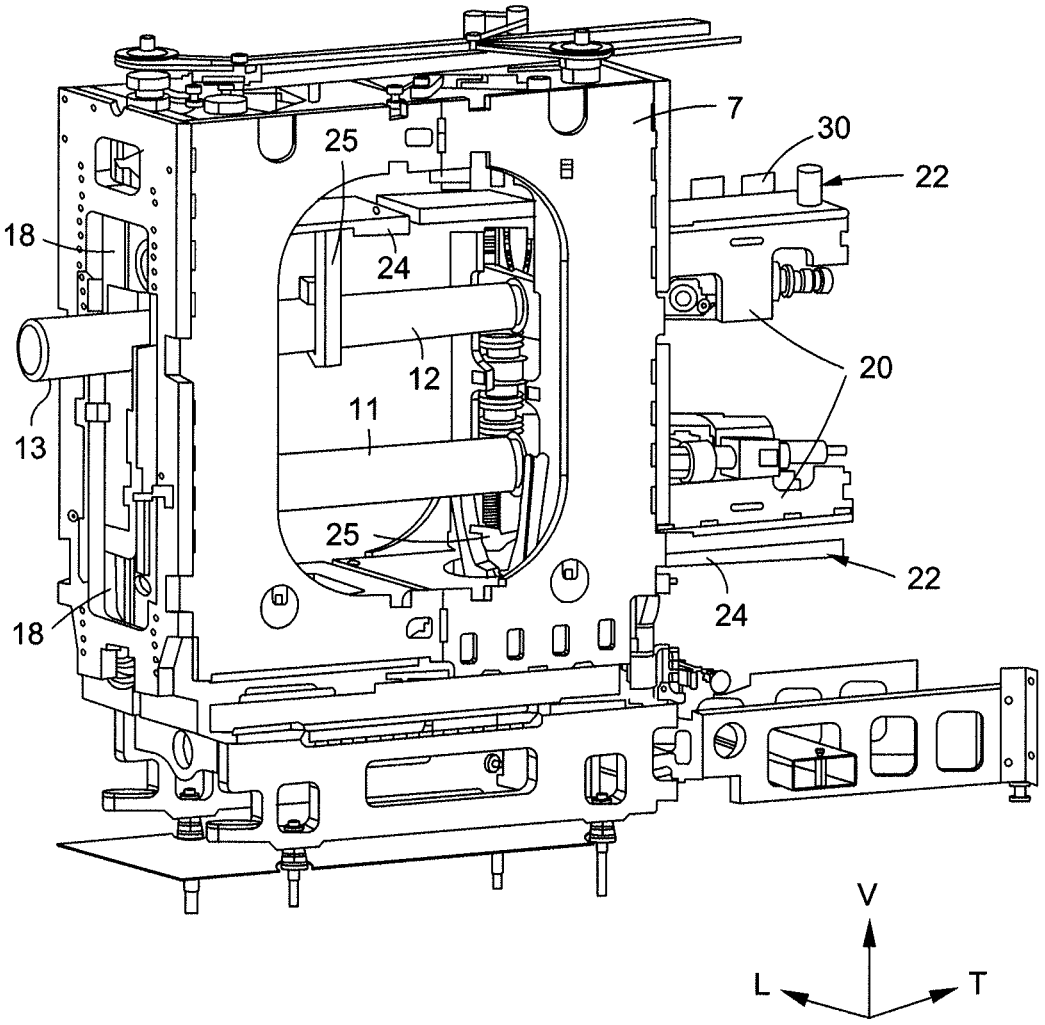
FIG. 7 shows a view similar to FIG. 3 with the sleeve extractor arranged in the upper part in the deployed position, some walls of the framework of the conversion unit not being shown.

The extraction head 24 is movable with respect to the base 23 between a withdrawn position (FIG. 3) and a deployed position in which the extraction head 24 is deployed in the transverse direction T. That is, parallel to the axis of rotation A1 and A2 of the rotary tools 10 and 11 (see sleeve extractor 22 arranged in the upper part in FIG. 7 in the deployed position).

The extraction head 24 comprises a gripper 25 that can engage with either side of a sleeve 13 in order to grasp the sleeve. The gripper 25 is mounted, for example, at the end of the extraction head 24.

Figure 5:
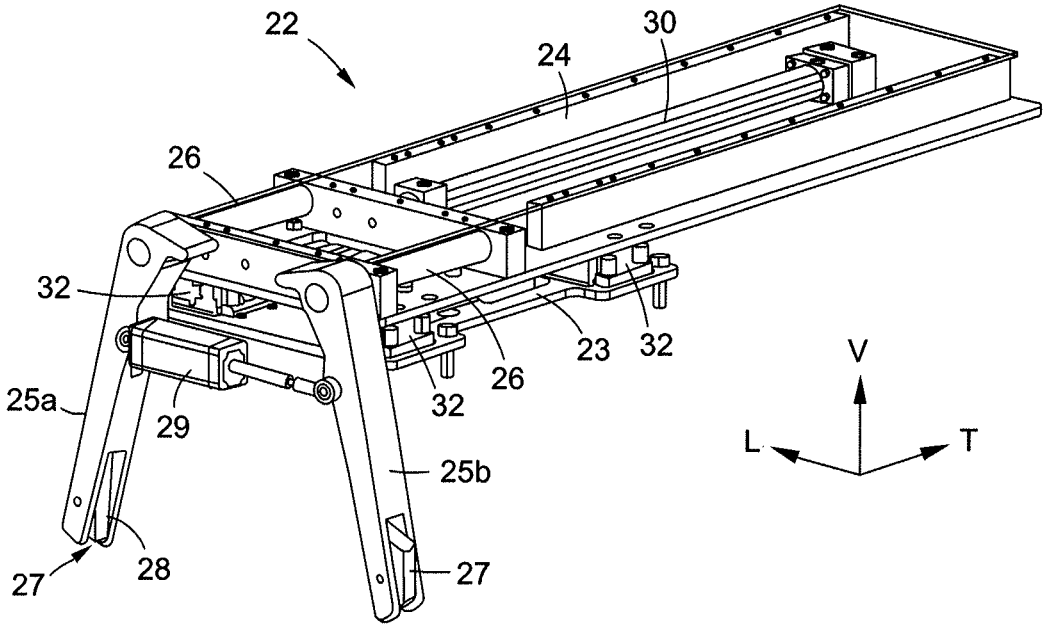
FIG. 5 shows the sleeve extractor from FIG. 4, arranged in the upper part of the conversion unit in which a cover of the extraction head is drawn so as to show the hidden detail.
Figure 6:
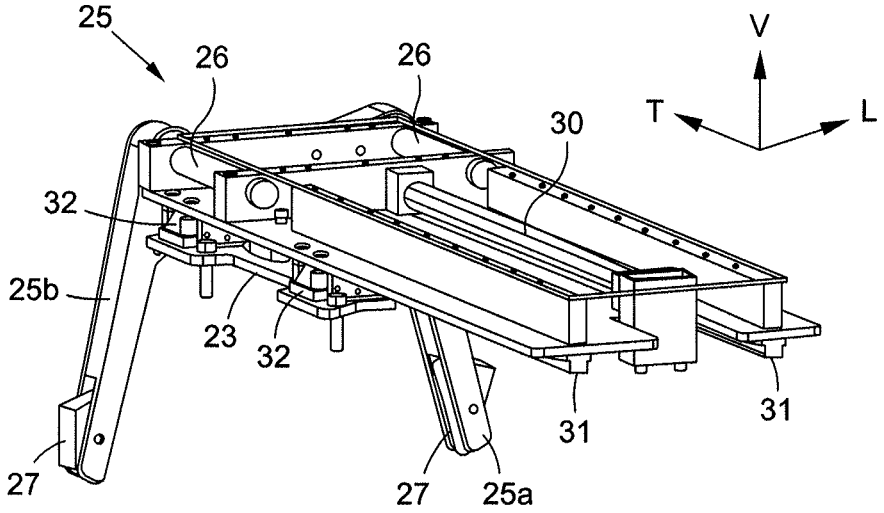
FIG. 6 shows a view from behind of the sleeve extractor from FIG. 5.

According to one exemplary embodiment, the gripper 25 comprises two pivoting arms 25*a* and 25*b*, each arm 25*a* and 25*b* being mounted, for example, on a respective pivot 26 of the extraction head 24. Once the sleeve extractor 22 is mounted in the conversion unit 7, the pivots 26 extend in the transverse direction T, parallel to the axis of rotation A1 and A2 of the mandrels 12, such that the arms 25*a* and 25*b* can pivot towards one another in order to grasp a sleeve 13 transversely (FIG. 5).

The gripper 25 can also comprise two gripping jaws 27 that are mounted in a pivotable manner about a transverse direction T, in an opening formed in one end of each arm 25*a* and 25*b* of the gripper 25. The inner sides of the gripping jaws 27 that are intended to be in contact with the sleeve 13 have, for example, a shoulder 28 in the form of a circular arc, complementary to the circular section of the sleeve 13, for receiving an end portion of sleeve 13, regardless of the diameter of the sleeve 13.

The pivoting gripping jaws 27 make it possible to position them properly on the sleeve 13 and to grip the sleeve 13 easier without any risk of damage, but with sufficient rigidity to push the sleeve 13 over the mandrel 12. The gripping jaws 27 comprise a part made, for example, of synthetic material, such as PET-C, or any other material to avoid the risk of damage to the sleeve 13. The gripping jaws 27 also comprise a metal part in order to be sufficiently rigid to be able to subsequently push the sleeve 13 over the mandrel 12.

The gripper 25 can also comprise a gripper actuator 29, such as a cylinder, for actuating the opening and closing of the gripper 25, thus making it possible for the opening thereof to be controlled in an automatic manner by the conversion unit 7.

The gripper actuator 29 is arranged, for example, between the arms 25*a* and 25*b* of the gripper 25. The gripper actuator 29 comprises a pedestal and a movable end. The pedestal is connected to one arm 25*a* of the gripper 25. The movable end is connected to the other arm 25*b* and extends from the pedestal in a direction perpendicular to the direction of the axis of rotation A1 and A2 of the mandrels 12. The pedestal and the movable end of the gripper actuator 29 are fixed to the arms 25*a* and 25*b* between the gripping jaws 27 and the pivots 26, so as not to impede the grasping of the sleeve 13.

The sleeve extractor 22 also comprises a head actuator 30, such as a cylinder, for moving the extraction head 24 between the withdrawn position and the deployed position, thereby making it possible for the movement of the extraction head 24 to be controlled in an automatic manner by the conversion unit 7 (FIG. 5).

The head actuator 30 comprises a pedestal and a movable end. The pedestal is fixed to the framework of the conversion unit 7. The movable end is connected to the extraction head 24 and extends from the pedestal in a direction parallel to the direction of the axis of rotation A1 and A2 of the mandrels 12.

The extraction head 24 can comprise a guide member 31 that engages with a complementary guide member 32 carried by the base 23 or by the conversion unit 7 (not shown) in order to guide the movement of the extraction head 24 between the withdrawn position and the deployed position.

The extraction head 24 comprises, for example, two guide rails 31 that are parallel to one another and parallel to the axis of rotation A1 and A2 of the mandrels 12. The guide rails 31 engage with four complementary guide members 32 carried by the base 23. Conversely, the guide rails can be carried by the conversion unit 7, or the base 23 and the complementary guide members by the extraction head 24.

The sleeve extractors 22 are mounted vertically one above the other in the conversion unit 7 on either side of the rear bearings 19 arranged at the rear of the conversion unit 7. The sleeve extractors 22 face one another and are mounted opposite one another. The two sleeve extractors 22 are, for example, identical.

In the withdrawn position shown in FIG. 3, the extraction head 24 is retracted at the rear of the conversion unit 7. The extraction head 24 extends above the motorized drive systems 20 for the sleeve extractor 22 arranged in the upper part, and therebelow for the sleeve extractor 22 arranged in the lower part. In the withdrawn position, the gripper 25 is open and the spaced-apart arms 25*a* and 25*b* do not touch the rotary tools 10 and 11.

In order to extract a sleeve 13, and in a first step, the gripper 25 of the extraction head 24, by means of the gripper actuator 29, engages with and grasps the end of the sleeve 13.

Next, in a second step, the extraction head 24 is deployed in the transverse direction T, parallel to the axis of rotation A1 and A2 of the mandrels 12. Since the ends of the mandrels 12 are held in the rear bearings 19 of the conversion unit 7 by the motorized drive systems 20, the sleeve 13 can be pushed along the mandrel 12 (see sleeve extractor 22 arranged in the upper part in FIG. 7) until it is extracted from the conversion group 7, by means of the head actuator 30.

Thus, the sleeve extractor 22 makes it easier to remove the sleeve 13 from the mandrel 12. Moreover, by virtue of the gripper 25, one and the same sleeve extractor 22 can be suitable for the extraction of sleeves 13 of different diameters.

The present invention is not limited to the embodiments described and illustrated. Numerous modifications can be made without otherwise departing from the scope defined by the set of claims.

The invention claimed is:

1. A rotary-tool sleeve extractor for a conversion unit for converting a flat substrate, the rotary-tool sleeve extractor comprising:

a base configured to be fixed to the conversion unit; and an extraction head that a) is configured to move with respect to the base between a withdrawn position and a deployed position, and b) comprises a gripper that is configured to engage with a sleeve of a rotary tool, wherein the gripper comprises two pivoting arms and a gripper actuator configured to actuate an opening and a closing of the gripper, wherein the gripper actuator is positioned between the two pivoting arms of the gripper and is directly connected to at least one arm of the two pivoting arms of the gripper, and wherein the gripper actuator comprises a movable end, wherein the movable end is connected to one of the two pivoting arms and extends in a direction perpendicular to a direction of axis of rotation of the rotary tool, such that movement of the movable end actuates the two pivoting arms are actuated to pivot towards one another, wherein the extraction head comprises a guide member comprising a guide rail positioned and configured to engage with a complementary guide member carried by the base, and wherein the base is vertically off-set from the axes of rotation of the rotary tools.

2. The extractor according to claim 1, further comprising a head actuator configured for moving the extraction head between the withdrawn position and the deployed position.

3. The extractor according to claim 1, wherein the extraction head comprises a guide member that engages with a complementary guide member of the base in order to guide the extraction head that is movable between the withdrawn position and the deployed position.

4. The extractor according to claim 1, wherein the gripper comprises at least one gripping jaw mounted in a pivotable manner in an arm of the gripper.

5. The extractor according to claim 4, wherein the gripping jaw comprises a shoulder in the form of a circular arc that is intended to receive an end portion of sleeve.

6. A conversion unit for converting a flat substrate comprising the sleeve extractor according to claim 1, wherein the extraction head is deployed in a direction parallel to an axis of rotation of a mandrel.

7. A conversion unit according to claim 6, further comprising:

two sleeve extractors that are mounted one above the other, facing one another, on either side of bearings of the conversion unit that are configured to support ends of mandrels.

8. A method for extracting a sleeve from a conversion unit according to claim 6, the method comprising:

bringing the gripper of the extraction head into engagement with an end of the sleeve in order to start an extraction of the sleeve; and deploying the extraction head in order to push the sleeve along the mandrel until it has been completely extracted from the conversion unit.

9. A method for extracting a sleeve from a conversion unit, the method comprising:

at least one rotary-tool sleeve extractor for a conversion unit for converting a flat substrate, the at least one rotary-tool sleeve extractor comprising:

a base to be fixed to the conversion unit; and an extraction head that comprises a guide member comprising a guide rail positioned and configured to engage with a complementary guide member carried by the base, and the extraction head:

a) is movable with respect to the base between a withdrawn position and a deployed position, and b) has a gripper configured to engage with a sleeve of a rotary tool, the gripper comprising:

two pivoting arms, and a gripper actuator configured to actuate an opening and a closing of the gripper, the gripper actuator positioned between the two pivoting arms and is directly connected to at least one arm of the two pivoting arms of the gripper, wherein the gripper actuator comprises a movable end connected to one of the two pivoting arms and extending in a direction perpendicular to a direction of axis of rotation of the rotary tool, such that movement of the moveable end actuates the two pivoting arms to pivot towards one another, wherein the extraction head is movable between a withdrawn position and a deployed position and is deployed in a direction parallel to an axis of rotation of a mandrel, the method comprising:

bringing the gripper of the extraction head into engagement with an end of the sleeve in order to start an extraction of the sleeve, by actuating the gripper actuator and by pivoting the two arms of the gripper toward one another in order to grasp the sleeve transversely; and deploying the extraction head in order to push the sleeve along the mandrel until it has been completely extracted from the conversion unit, wherein the base is vertically off-set from the axes of rotation of the rotary tools.

* * * * *